United States Patent [19]

Clark et al.

[11] 4,448,417

[45] May 15, 1984

[54] PINBALL GAME WITH SIMULATED PROJECTILE DISPLAY

[75] Inventors: Norman R. Clark, Burbank; George Christian, Melrose Park, both of Ill.

[73] Assignee: Bally Manufacturing Corporation, Chicago, Ill.

[21] Appl. No.: 370,983

[22] Filed: Apr. 22, 1982

[51] Int. Cl.[3] ..... A63F 7/02

[52] U.S. Cl. ..... 273/121 A; 273/1 GC

[58] Field of Search ..... 273/121 A, 85 G, 94, 273/1 G, 1 C, 1 E

[56] References Cited

U.S. PATENT DOCUMENTS

| | | | |
|---|---|---|---|
| 2,627,411 | 2/1953 | Bartlam et al. | 273/121 A X |
| 3,874,669 | 4/1975 | Ariano | 273/83 G |
| 4,093,223 | 6/1978 | Wilke et al. | 273/85 G X |
| 4,323,241 | 4/1982 | Deutsch | 273/121 A |
| 4,334,679 | 6/1982 | Doyle et al. | 273/85 G |
| 4,357,014 | 11/1982 | Baer et al. | 273/85 G |
| 4,373,725 | 2/1983 | Ritchie | 273/121 A |
| 4,375,286 | 3/1983 | Seitz et al. | 273/121 A |

*Primary Examiner*—Paul E. Shapiro

*Attorney, Agent, or Firm*—Welsh & Katz

[57] ABSTRACT

A pinball game, in addition to having an aspect in which a real projectile, i.e., a pinball, is manipulated to strike various targets, has a simulated projectile aspect in which a projectile is simulated by stepwise illumination of lights on an array. Events, in the simulated aspect, such as initiation of the simulated aspect, result from events on the playfield of the real projectile, such as retention of the projectile by a projectile-capture target, and events, such as release of the projectile from the projectile-capture target, result from events in the simulated aspect, such as completion or noncompletion of a maze. The player's total score is reflective of events on both the real and simulated aspect of the game.

14 Claims, 4 Drawing Figures

PINBALL GAME WITH SIMULATED PROJECTILE DISPLAY

The present invention relates to pinball games and more particularly to pinball games having both real and simulated projectiles.

BACKGROUND OF THE INVENTION

A wide variety of games of skill, generally known as "pinball games", have been made available for the entertainment of the public. These games utilize a projectile, such as a metal ball, which the player, through various control devices, manipulates and directs at various targets on a slightly inclined playing field. The variety of games offered to the public reflects the desire of the playing public for new and different challenges reflected in the variety of games. Within the genre of pinball games, most of the variation is provided by variations in the playfield, i.e., the variety and arrangement of targets, scoring systems, sound effects and artwork. The actual means of manipulating the projectile has remained relatively constant, i.e., initially introducing the projectile onto the playfield with a spring-loaded plunger, and thereafter directing the ball up the inclined surface at the targets by means of flippers situated toward the lower end of its playfield. It is felt a greater variety and increased player interest can be obtained by introducing additional skills to the playfield.

It is a general object of the present invention to provide pinball games of greater variety, and a particular object of the invention is to provide a pinball game having both real and simulated projectiles.

DETAILED DESCRIPTION OF THE PREFERRED EMBODIMENTS

Figure 1:
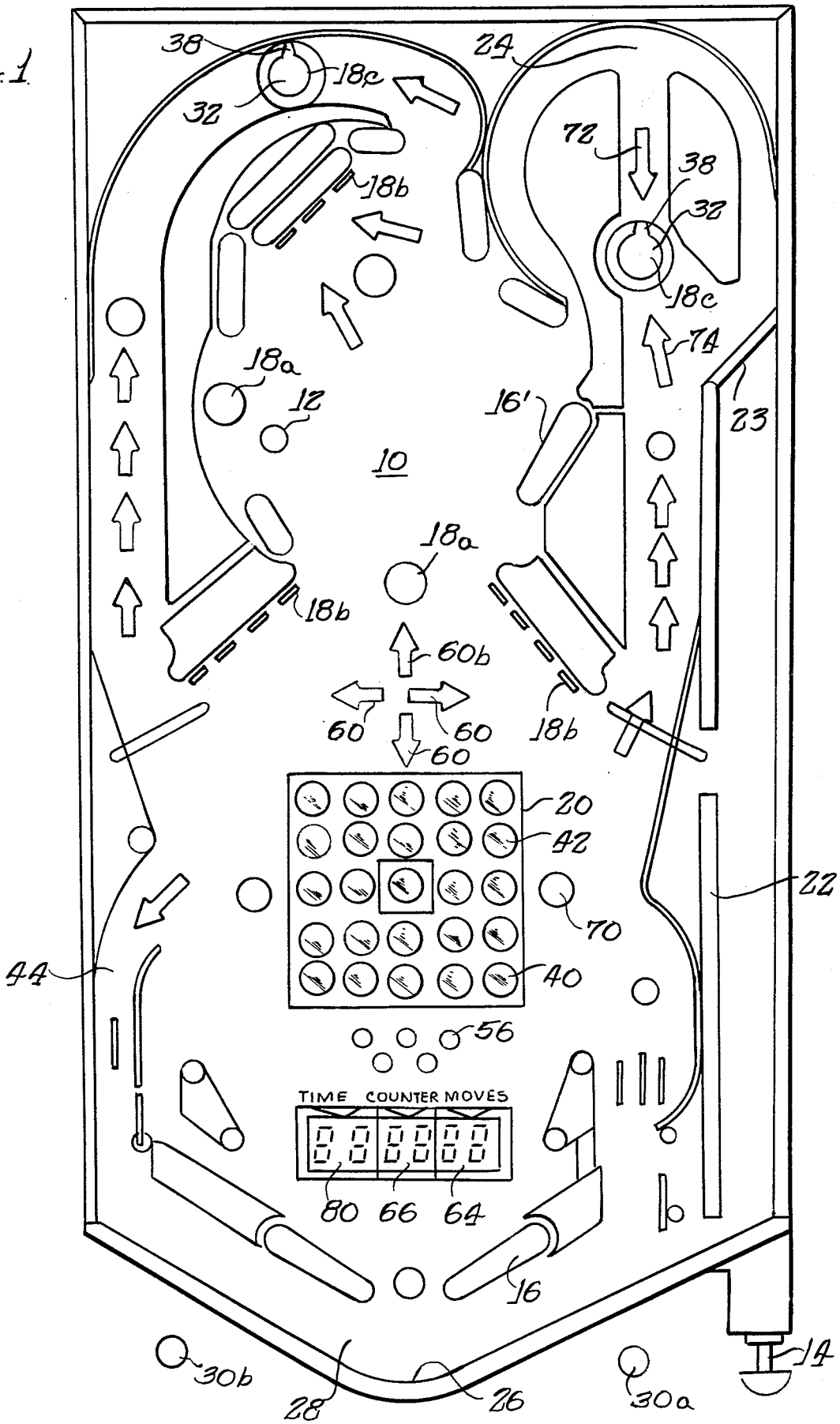
FIG. 1 is a plan view of a pinball playfield, including a simulated projectile display, embodying various features of the present invention.

Illustrated in FIG. 1 is a pinball playfield 10 having a real projectile 12, means 14, 16 of manipulating the projectile, targets 18 for the projectile and a simulated projectile display 20.

The apparatus for playing the real projectile 12, e.g., a metal ball, is typical of pinball game apparatus. Balls 12 are shot into play, one at a time, by a spring-loaded plunger 14, the shot ball following a pathway defined by an elongated guide 22 having a one-way exit gate 23 to the upper end 24 of the inclined playfield 10. From the upper end 24, the ball 12 rolls down the incline encountering various targets 18 along the way scoring points for the player. Once free of the targets 18, the ball 12 rolls down the incline toward a ball exit 26 at the lower end 28 of the playfield where the ball is removed from play unless the player intercepts the downward roll of the ball with projectile-manipulating means, such as flippers 16, that are actuated by player operated means, such as buttons 30, at the front of the game. If the player intercepts the ball 12 and returns it by means of the flippers 16 toward the back or upper end 24 of the playfield 10, the ball hits various targets 18 increasing the score of the player. Additional flippers 16' are optionally provided at other locations on the playfield. Generally the score accumulated by the ball hitting each target is reflective of the difficulty encountered in hitting the target.

Targets 18 shown on the playfield 10 are representative of types of targets which are commonly included in pinball machines including bumpers **18*a*, flip-up targets 18*b*, etc. The illustrated playfield 10** is simplified, and in actual practice, a playfield may have a substantially greater number of targets.

In accordance with the present invention, the game, in addition to having the various apparatus needed to play the metal ball, has the simulated projectile displays 20 in which a projectile is represented by a stepwise actuation of lights. The user moves the simulated projectile by means of external controls, which may be the same controls **30*a,b* that are used to actuate the flippers 16**, to accomplish certain goals, such as escape or pursuit of a simulated "enemy" projectile.

The simulated aspect of the game might be played concurrently with the real projectile aspect of the game; however, it is contemplated that the simulated aspect of the game will generally be played intermittently with the real projectile game, such as when a certain event occurs in the real projectile game. Such an event may be the striking of a particular target **18*c* by the real projectile. The playfield 10 includes one or more ball-retaining targets 18*c*, herein, eject saucers including a depressed well 32 in the playfield in which the ball may drop. Appropriate sensing means are provided in the eject caucer 18*c* so that when the ball drops therein, electronic controls, such as microprocessors, activate the simulated aspect while the real projectile aspect is temporarily interrupted as a result of ball retention in the eject saucer. The game is programmed so that an event in the simulated aspect, such as capture of the player's last simulated projectile by the simulated enemy projectile or successful escape from the enemy by using up all available moves, will deactivate the simulated aspect, whereupon, an eject pin 38 in the saucer 18*c* operates to eject the ball 12 from the well 32 and return it to play. The ball-retaining target 18*c*** could also be an electromagnet which magnetically holds the metal ball until the power supplied thereto is cut off in response to an event in the simulated aspect.

Herein, the simulated projectile is provided by an array of light means 40 in the playfield 10. A 5×5 array of light means 40 are represented, and the player's simulated projectile is represented by the stepwise actuation of adjacent light means of the array. The player manipulates his simulated projectile by operation of the external controls or buttons 30. In a rectangular array, such as is shown here, the movement along the array will typically be one space at a time horizontally or vertically. The movement of the simulated projectile will be directed to a particular purpose, such as illuminating all of the lights by successfully moving the projectile to each of the locations on the array within a predetermined number of moves. A particularly exciting purpose of the simulated projectile is pursuit or escape from an "enemy" simulated projectile, also represented by stepwise actuation of the individual light means 40 of the array. Preferably, when the object of the simulated aspect is pursuit, the simulated enemy projectile is of a different color than the player's simulated projectile.

Figure 2:
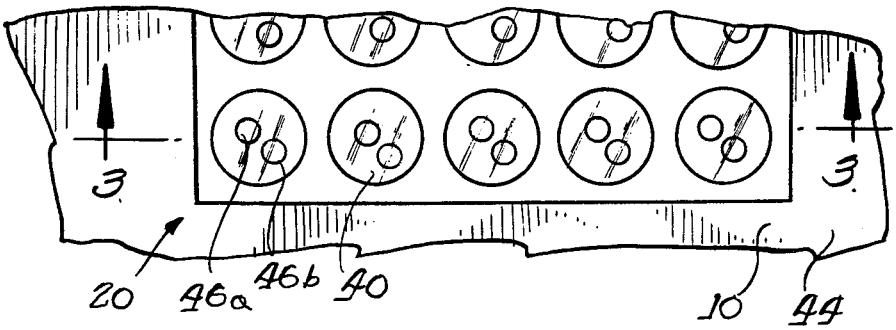
FIG. 2 is an enlarged fragmentary plan view of the simulated projectile display of FIG. 1.
Figure 3:
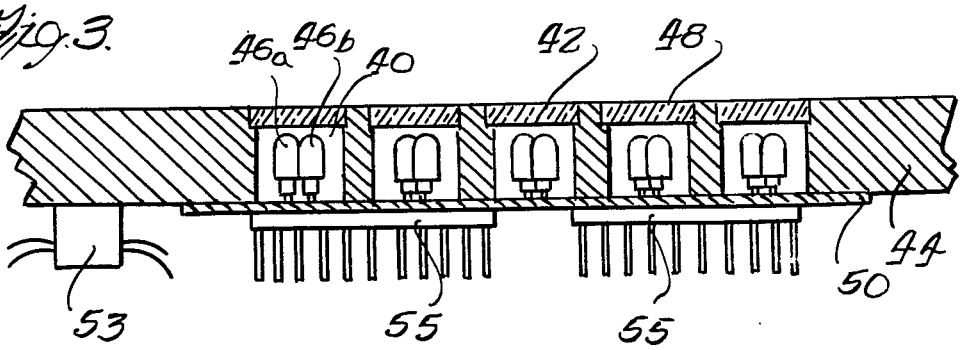
FIG. 3 is a cross-sectional view taken along line 3—3 of FIG. 2.
Figure 4:
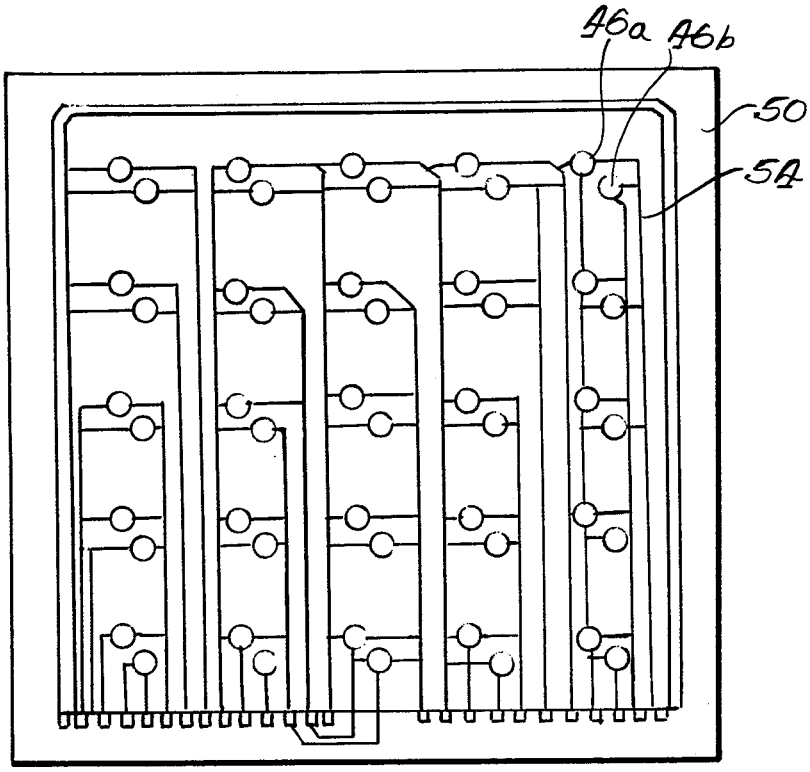
FIG. 4 is a plan view of a circuit board with a light bulb array for the simulated projectile display.

As a means of providing the array 20 of light means 40, an array of lenses 42 are embedded in the board 44 that provides the playfield 10, under which is an array of luminescent devices, such as incandescent bulbs 46*a,b*, for illuminating the same. The upper surfaces 48 of the lenses 42 are flat and flush with the playfield 10 so as not to interfere with the roll of the ball 12. The array of bulbs 46, illustrated in FIGS. 2–4, is for a pursuit game involving a player controlled simulated projectile and a microprocessor controlled enemy simulated projectile. A 5×5 array of bulb pairs 46*a,b* are provided on the upper surface of a circuit board 50 disposed beneath the playfield 10, each pair of bulbs 46 being directly below one of the lenses 42. The bulbs 46 are preferably plugged individually into the circuit board 50 to provide for individual bulb replacement. The bulbs 46*a,b* of each pair are of different colors, one color bulb 46*a*, e.g., yellow, representing the player's simulated projectile, and one color bulb 46*b*, e.g., red, representing the simulated enemy projectile. The printed circuit 54 on the upper surface of the circuit board provides for illumination of the bulbs 46*a,b* according to the strategy of the game. Plug means 55 on the under side of the circuit board connect the printed circuit 54 to an electronic control 53, e.g., microprocessor, such as are known in the electronic art, and this control manipulates the enemy projectile according to a predetermined pattern or in response to movement of the player's simulated projectile. The electronic control 53 also interfaces the simulated projectile aspect with the real projectile aspect and interfaces the events in both aspects to scoring and sound apparatus.

The pinball game of the present invention provides for test of player skill in addition to the usual ball manipulation skills. The final score of the player is determined by his skill in both aspects of the game. The scoring system of the game is adapted to maximize the interrelationship between the real projectile aspect and the simulated projectile aspect. The player may accumulate points at a rapid rate by playing the simulated aspect; however, his opportunity to play the simulated aspect is dependent on his ability to maintain the ball 12 in play and his ability to direct the ball to a particular target, i.e., the eject saucer 18*c*, that activates the simulated game. His ability to take advantage of the opportunity to score points in the simulated aspect depends upon his skill in manipulating the simulated projectile. Furthermore, the player's opportunity to play the real projectile aspect is determined by his skill in the simulated projectile aspect if rewards, such as additional balls, accrue upon the accomplishment of certain objectives in the simulated aspect.

In order that the invention may be more fully understood, an example of a pinball game, with particular emphasis on the simulated projectile aspect, will now be described in greater detail.

By means of the plunger 14, the player puts his first ball 12 in play at the upper end 24 of the playfield 10. As the ball 12 rolls down the inclined playfield 10, it strikes various targets 18 providing some initial points to the player. The player guards against the ball 12 leaving through the exit 26 by means of pairs of flippers 16, each flipper actuated by its own player-controlled button 30 at the front of the game. The flippers 16 propel the ball 12 upwards on the playfield to strike the various targets 18. The targets 18 that the ball 12 strikes and the score accumulated thereby depends upon the skillful manipulation of the flippers 16 by the player as well as some permissable jarring of the playfield 10. When the ball 12 lands in one of the eject saucers 18*c*, play of the ball 12, dependent on certain other requirements, is halted and the simulated projectile aspect of the game begins.

The player is provided with a given number of simulated projectiles, herein five as indicated by the five lighted counter indicia 56 below the light array 20. By pressing one of the flipper buttons 30*a*, the player puts one of his simulated projectiles in play as indicated by illuminating one of the lenses 42 of the array with a bulb 46*a* of the player's color. It is also accompanied by the introduction of the enemy simulated projectile onto the array by illuminating one of the lenses 42 of the array with a bulb 46*b* of the enemy color. The player uses one flipper button 30*a* to move his simulated projectile and the other button 30*b* to determine the direction in which the simulated projectile moves. The direction of the projectile effected by depression of the projectile-moving button 30*a* is indicated by means of arrows 60 above the display 20. One of four arrows 60 indicating up or down or left or right movement is lit at all times during the simulated aspect of the game, and the player changes the arrow that is illuminated in a rotational, e.g. clockwise, direction by successive depressions of the directional button 30*b*. Thus by the coordinated manipulation of both buttons 30*a,b*, the player moves the simulated projectile in the direction of his choosing. As the player moves, the electronic control moves the enemy either in response to a predetermined sequence, a random motion sequence or in response to the player's moves.

If the enemy is the pursuer, the object of the player is to avoid the enemy for a predetermined number of moves as indicated by a move tabulator 64. If the player completes the maze by completing the object of the maze while avoiding the pursuing enemy for the predetermined number of moves, he is credited with a completion as recorded on a counter 66 as well as rewarded with points on his total score. If instead, his simulated projectile is captured by the enemy as a result of the enemy simulated projectile occupying the same position as the player's simulated projectile, he is credited with no completion and looses this one of his simulated projectiles. He may, however, be credited with some score according to his number of escape manueuvers. If the player's simulated projectiles are depleted through enemy capture, he can earn no points in the simulated aspect even if he would otherwise have the right to play the simulated aspect by virtue of his projectile landing in the eject saucer 18*c* except under special conditions where the player again earns the right to play the simulated aspect.

On the other hand, the player may be the pursuer who must capture the enemy by landing on the same space within a predetermined number of moves. If during the play of one real ball, the player becomes the aggressor, he remains the aggressor each time he triggers an event which puts him in the simulated aspect of the game until that real ball is lost from play. If enemy capture occurs, the player is appropriately rewarded with points.

In the illustrated game, it is contemplated that different events will alternatively result in the player and the enemy being the aggressor (pursuer). An event which may be used to determine whether the player is the pursuer or pursued might be the direction which the ball 12 enters the eject saucer 18*c*. For example, if the ball enters the eject saucer 18*c* at the upper right hand corner from below in the direction of arrow 74 as a result of ball manipulation with the flipper 16, the enemy will be the aggressor. On the other hand, if the ball 12 enters the saucer 18*c* from above in the direction of arrow 72, an event which will generally occur only when the player has carefully activated the plunger 14 to put the ball 12 in play, i.e., the skill shot, the player will be the aggressor or pursuer. The player might also become the aggressor by striking a certain sequence of targets before landing in the eject saucer 18*c*. A light 70 at the right of the array indicates that the player is the aggressor.

To add incentive for skillful play, a total replay may be awarded if a player completes the maze within a predetermined time indicated by a timer 80 below the array. The predetermined time may be adjustable by the arcade proprietor to slow down or speed up play according to the volume in his establishment and according to the general skill of his clientele.

The variations on such a game and the interrelationships between the real aspect and the simulated aspect are endless. For example, the player may be granted additional simulated projectiles for striking certain particularly inaccessible targets 18 with the ball 12. The play on the simulated aspect may be made more difficult on each subsequent play. For example, on the first play of the simulated aspect, the enemy may move only in response to player movement. On the next play, the enemy may move within a predetermined time irrespective of player action. The movement of the enemy may quicken on subsequent plays. Through the use of microprocessors, the speed of the enemy is virtually unlimited so that even the most skillful player will eventually be challenged to the limits of his ability. The simulated aspect may include a two man mode wherein a competing player rather than an electronic control operates the opposing simulated projectile.

While the invention has been described in terms of a certain preferred embodiment, modifications obvious to one with ordinary skill in the art may be made without departing from the scope of the invention. For example, although the illustrated game contemplates a pursued and a pursuer, a single bulb associated with each lens might be used in a straight-forward maze. The simulated projectile(s) is generally indicated by stepwise illumination of lights; however, it could also be represented by stepwise extinguishing of the lights in the display. LED's might be used in place of incandescent bulbs to simulate a projectile. While it is preferred that the light array be on the playing field, the array may be on an upright light box at the rear of the game where the score is generally displayed. Instead of using the flipper buttons to move the simulated projectile, separate controls such as additional buttons, handles, levers, guns, etc. might be provided. The simulated aspect might operate simultaneously with the real projectile aspect, requiring a player to coordinate his evasive action with his manipulation of the ball by use of the flipper buttons or other controls.

Various features of the invention are set forth in the following claims.

What is claimed is:

1. A pinball game comprising a playfield having a plurality of targets, means for introducing a projectile onto said playfield, means for manipulating said projectile on said playfield to contact said targets, a plurality of individual light devices in a spatial array, means for actuating one of said light devices, player controlled means for stepwise actuating the other light devices to simulate a projectile, means on the playfield for indicating a player determined direction of stepwise actuation of the simulated projectile, means providing an objective for movement of said simulated projectile, and scoring means for tabulating events of said projectile on said playfield and events on said array.

2. A game according to claim 1 wherein a second simulated projectile is movable along said array.

3. A game according to claim 2 wherein said second simulated projectile is a different color than said first simulated projectile.

4. A game according to claim 2 wherein an electronic control moves said second simulated projectile.

5. A game according to claim 4 further comprising means for activating said spatial array in response to each occurrence of a predetermined event on said playfield, and wherein the electronic control increases the speed at which said second simulated projectile is moved in response to each subsequent activation of said spatial array.

6. A game according to claim 2 further comprising second player controlled means for actuating said second simulated projectile thereby permitting a competing player mode.

7. A game according to claim 1 wherein said array comprises a plurality of lenses in the playing field and an array of luminescent devices disposed below said lenses.

8. A game according to claim 7 including a board on which said luminescent devices are arranged, said board having a printed circuit whereby said luminescent devices can be individually actuated.

9. A game according to claim 1 wherein said manipulating means also functions as said player controlled means for stepwise illumination of said light devices.

10. A game according to claim 1 having a first player control to determine direction of said simulated projectile and second player control to move said simulated projectile in the determined direction.

11. A game according to claim 1 having a projectile-retaining target, means associated with said projectile-retaining target for activating said spatial array, and means for releasing said ball from said projectile-retaining target pursuant to an event on said spatial array, whereby said projectile and said simulated projectile are manipulated independently.

12. A game according to claim 11 further comprising timing means for reactivating said spatial array in response to occurrence of said event on said spatial array within a predetermined time after activation of said spatial array.

13. A game according to claim 1 wherein an electronic control provides said means providing the objective.

14. A game according to claim 1 wherein a final score is determined by a combined tabulation of events of said projectile on said playfield and events on said array.

* * * * *